US009128424B2

(12) United States Patent
Hiramatsu et al.

(10) Patent No.: US 9,128,424 B2
(45) Date of Patent: Sep. 8, 2015

(54) BELT CLEANING CONFIGURATION FOR AN IMAGE FORMING APPARATUS

(71) Applicants: Hiroshige Hiramatsu, Inuyama (JP); Takamasa Tsukada, Ichinomiya (JP)

(72) Inventors: Hiroshige Hiramatsu, Inuyama (JP); Takamasa Tsukada, Ichinomiya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 93 days.

(21) Appl. No.: 13/922,936

(22) Filed: Jun. 20, 2013

(65) Prior Publication Data

US 2014/0376962 A1 Dec. 25, 2014

(51) Int. Cl.
*G03G 15/20* (2006.01)
*G03G 15/16* (2006.01)

(52) U.S. Cl.
CPC ..... *G03G 15/168* (2013.01); *G03G 15/161* (2013.01); *G03G 2215/1652* (2013.01)

(58) Field of Classification Search
USPC ..... 399/101, 123, 302, 303, 308
See application file for complete search history.

(56) References Cited

U.S. PATENT DOCUMENTS 5,701,566 A * 12/1997 Bisaiji et al. ..... 399/302
7,697,855 B2 4/2010 Fukami et al.
8,437,657 B2 5/2013 Kikuchi et al.
2003/0161652 A1* 8/2003 Nishiwaki ..... 399/101
2008/0056743 A1 3/2008 Fukami et al.
2011/0158677 A1 6/2011 Kikuchi et al.

FOREIGN PATENT DOCUMENTS

| | | |
|---|---|---|
| JP | 7306602 | 11/1995 |
| JP | 2003-066673 A | 3/2003 |
| JP | 2003-241515 A | 8/2003 |
| JP | 2008-058475 A | 3/2008 |
| JP | 2008-058566 A | 3/2008 |
| JP | 2010-128289 A | 6/2010 |
| JP | 2011-118192 A | 6/2011 |
| JP | 2011-133664 A | 7/2011 |

OTHER PUBLICATIONS

May 26, 2015—(JP) Notification of Reasons for Refusal—App 2011-167379—partial Eng Tran.

* cited by examiner

*Primary Examiner* — Hoang Ngo
(74) *Attorney, Agent, or Firm* — Banner & Witcoff, Ltd.

(57) ABSTRACT

An image forming apparatus includes an image carrier configured to carry thereon a developer image, an endless belt configured to be rotated while contacting the image carrier, a first cleaning roller having an outer surface made of semiconductor material and configured to electrically remove attachments attached on the endless belt, and a backup roller made of metal and arranged to oppose the first cleaning roller with the endless belt being interposed therebetween. The endless belt has a nip portion at which both the backup roller and the first cleaning roller contact the endless belt while opposing each other, and the first cleaning roller contacts the endless belt at a more upstream side than the nip portion in a moving direction of the endless belt.

10 Claims, 5 Drawing Sheets

BELT CLEANING CONFIGURATION FOR AN IMAGE FORMING APPARATUS

CROSS-REFERENCE TO RELATED APPLICATION

This application is based on Japanese Patent Application No. 2011-167379, filed on Jul. 29, 2011, the entire subject matter of which is incorporated herein reference.

TECHNICAL FIELD

Aspects of the present invention relate to an image forming apparatus of an electro-photographic type.

BACKGROUND

There has been known an image forming apparatus such as a laser printer which uses an endless belt so as to perform sheet conveyance, intermediate transfer and the like.

In this image forming apparatus, a belt cleaning device using a roller or brush is provided to remove foreign matters such as toner or paper powders attached on the belt. In the belt cleaning device, a cleaning roller which removes the foreign matters such as toner or paper powders contacts a surface of the belt.

For example, JP-A-2008-58475 describes a configuration where a cleaning roller is arranged to oppose a metallic electrode roller which is provided inside an annular conveyance belt, with the conveyance belt being interposed therebetween, and the toner or paper powders are electrically removed.

In the above-described configuration, since the electrode roller is made of metal, an electric discharge is more apt to occur between the electrode roller and the conveyance belt at upstream and downstream sides in a moving direction of the conveyance belt than between the cleaning roller and the electrode roller. That is, since the electrode roller formed of the metal has an electric resistance smaller than that of a roller made of semiconductor material, charges accumulated on the conveyance belt are apt to flow towards the electrode roller.

If the electric discharge occurs between the conveyance belt and the electrode roller, a polarity of the foreign matters attached on the conveyance belt may be changed. If the polarity is changed, the foreign matters cannot be collected by the cleaning roller.

SUMMARY

Accordingly, an aspect of the present invention provides an image forming apparatus capable of securely removing attachments attached on an endless belt.

According to an illustrative embodiment of the present invention, there is provided an image forming apparatus including an image carrier, an endless belt, a first cleaning roller, and a backup roller. The image carrier is configured to carry thereon a developer image. The endless belt is configured to be rotated while contacting the image carrier. The first cleaning roller has an outer surface made of semiconductor material and is configured to electrically remove attachments attached on the endless belt. The backup roller is made of metal and arranged to oppose the first cleaning roller with the endless belt being interposed therebetween. The endless belt has a nip portion at which both the backup roller and the first cleaning roller contact the endless belt while opposing each other. The first cleaning roller contacts the endless belt at a more upstream side than the nip portion in a moving direction of the endless belt.

According to the above configuration, it is possible to cause the endless belt to contact the first cleaning roller before the electric discharge occurring between the first cleaning roller and the backup roller strongly affects the endless belt.

Therefore, it is possible to suppress a charged polarity of the attachments attached on the endless belt from being changed before the attachment contacts the first cleaning roller.

As a result, it is possible to securely remove the attachments attached on the endless belt.

BRIEF DESCRIPTION OF THE DRAWINGS

The above and other aspects of the present invention will become more apparent and more readily appreciated from the following description of illustrative embodiments of the present invention taken in conjunction with the attached drawings, in which:

FIGS. 2A and 2B show a belt cleaner of FIG. 1, wherein FIG. 2A shows a relative arrangement between a belt cleaner roller and a backup roller, and FIG. 2B is a graph showing cleaning performance of the belt cleaner (a relation between a remaining degree of toner and an arrangement of respective assessment patches in a left-right direction);

FIGS. 3A and 3B show a belt cleaner of a comparative example 1, wherein FIG. 3A shows a relative arrangement between a belt cleaner roller and a backup roller, and FIG. 3B is a graph showing cleaning performance of the belt cleaner;

FIGS. 4A and 4B show a belt cleaner of a comparative example 2, wherein FIG. 4A shows a relative arrangement between a belt cleaner roller and a backup roller, and FIG. 4B is a graph showing cleaning performance of the belt cleaner; and FIGS. 5A and 5B show an intermediate transfer-type color printer which is an example of an image forming apparatus according to a modified embodiment of the present invention, wherein FIG. 5A is a schematic view showing a configuration in the vicinity of a belt unit, and FIG. 5B is a partial enlarged view of FIG. 5A.

DETAILED DESCRIPTION

1. Overall Configuration of Color Printer

Figure 1:
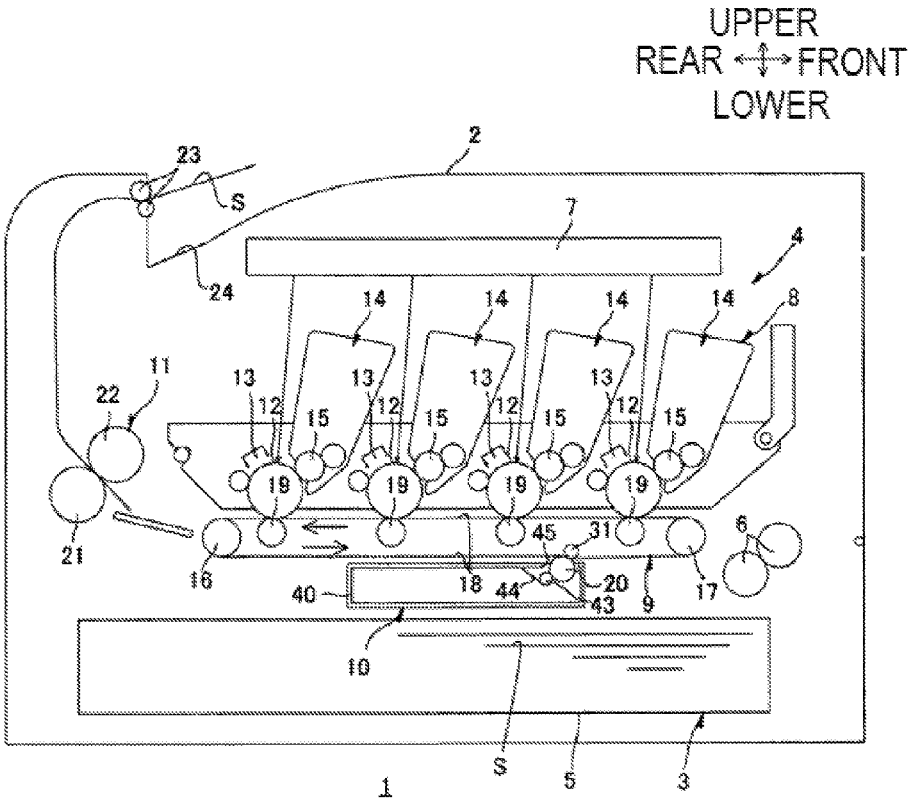
FIG. 1 is a sectional view of a printer which is an example of an image forming apparatus according to an illustrative embodiment of the present invention.

As shown in FIG. 1, a printer 1 which is an example of an image forming apparatus is a direct tandem color printer of a horizontal arrangement type.

In the below descriptions, the directions are described based on a state where the printer 1 is horizontally placed. That is, the right of FIG. 1 is referred to as a front side and the left of FIG. 1 is referred to as a rear side. Also, the left and the right are described based on a state where the printer 1 is seen from the front side. That is, the front of FIG. 1 is a left side and the back of FIG. 1 is a right side.

The printer 1 includes, in a body casing 2, a feeder unit 3 configured to feed a sheet S, and an image forming unit 4 configured to form an image on the fed sheet S.

(1) Body Casing

The body casing 2 has a substantially rectangular box shape when seen from a lateral side and accommodates therein the feeder unit 3 and the image forming unit 4.

(2) Feeder Unit

The feeder unit 3 includes a sheet feeding tray 5 which is provided at a bottom part in the body casing 2 and accommodates therein sheets S.

The sheets S accommodated in the sheet feeding tray 5 are fed one by one towards a pair of registration rollers 6 which are arranged at an upper side of a front end portion of the sheet feeding tray 5. The fed sheet S is then conveyed towards between the image forming unit 4 (a photosensitive drum 12 (described later)) and a conveyance belt 18 (described later) at predetermined timing.

(3) Image Forming Unit

The image forming unit 4 includes a scanner unit 7, a process unit 8, a transfer unit 9, a belt cleaner 10, and a fixing unit 11.

(3-1) Scanner Unit

The scanner unit 7 has a substantial box shape extending in horizontal direction and is provided at an upper part in the body casing 2. As shown with the solid lines, the scanner unit 7 emits laser beams based on image data towards four photosensitive drums 12 (described later), thereby exposing the photosensitive drums 12.

(3-2) Process Unit (3-2-1) Configuration of Process Unit

The process unit 8 is arranged to oppose a lower side of the scanner unit 7 at an upper of the transfer unit 9 and includes a photosensitive drum 12 (an example of an image carrier), a scorotron-type charger 13 and a developing unit 14.

The photosensitive drum 12 has a substantially cylindrical shape extending in the left-right direction. The four photosensitive drums 12 are provided in parallel with each other at an interval in the front-rear direction.

The scorotron-type charger 13 is arranged to oppose a rear-upper side of the photosensitive drum 12 at an interval from the photosensitive drum 12 so as to correspond to each photosensitive drum 12.

The developing unit 14 is arranged above the photosensitive drum 12 so as to correspond to each photosensitive drum 12. Also, each developing unit 14 has a developing roller 15.

The developing roller 15 is rotatably supported to a lower end of the developing unit 14 so as to be exposed from a rear side thereof. The developing roller 15 opposes and contacts the photosensitive drum 12 to press the photosensitive drum 12 from a front-upper side of the photosensitive drum 12.

The developing unit 14 accommodates toner (an example of developer) corresponding to each color in a space above the developing roller 15. Specifically, the toner is polymerized toner of non-magnetic one-component type.

(3-2-2) Developing Operation in Process Unit

The toner in the developing unit 14 is carried on a surface of the developing roller 15 as the developing roller 15 is rotated.

As the photosensitive drum 12 is rotated, a surface of the photosensitive drum 12 is uniformly charged by the scorotron-type charger 13 and then exposed by high-speed scanning of the laser beam (refer to the solid line in FIG. 1) emitted from the scanner unit 1. Thereby, an electrostatic latent image corresponding to an image which should be formed on the sheet S is formed on the surface of the photosensitive drum 12.

When the photosensitive drum 12 is further rotated, the toner carried on the surface of the developing roller 15 is supplied to the electrostatic latent image formed on the surface of the photosensitive drum 12. Thereby, the electrostatic latent image on the photosensitive drum 12 becomes visible and a toner image by a reversal developing is carried on the surface of the photosensitive drum 12.

(3-3) Transfer Unit and Belt Cleaner

The transfer unit 9 is arranged above the feeder unit 3 and below the process unit 8 along the front-rear direction in the body casing 2. The transfer unit 9 includes a driving roller 16, a driven roller 17, a conveyance belt 18 (an example of an endless belt), and four transfer rollers 19.

The driving roller 16 and the driven roller 17 are arranged to oppose each other at an interval in the front-rear direction.

The conveyance belt 18 is wound around the driving roller 16 and the driven roller 17 such that the conveyance belt 18 opposes the respective photosensitive drums 12 from the lower sides thereof and an upper side of the conveyance belt 18 contacts the respective photosensitive drums 12. The conveyance belt 18 is made of a resin such as polyethylene, polypropylene, polyamide, PVDF (polyvinylidene difluoride), PET (polyethylene terephthalate), nylon, polycarbonate, polyimide and the like, and has a volume resistivity of about $10^7$ to $10^{14}$ Ω·cm (at 25° C.), for example.

Also, as the driving roller 16 drives and the driven roller 17 is thus driven, the conveyance belt 18 is rotated such that the upper part of the conveyance belt 18 contacting the respective photosensitive drums 12 moves from the front side towards the rear side.

The respective transfer rollers 19 are arranged to oppose the respective photosensitive drums 12 with the upper part of the conveyance belt 19 being interposed therebetween.

The belt cleaner 10 is arranged above the sheet feeding tray 5 and below the conveyance belt 18. The belt cleaner 10 has a waste-toner accommodation unit 40, a belt cleaning roller 20 (an example of a first cleaning roller), a relay roller 43 (an example of a second cleaning roller) and a scraping blade 44 (an example of a blade).

The waste-toner accommodation unit 40 has a substantial box shape having an opening 45 at a front-upper end portion.

The belt cleaning roller 20 is rotatably supported in the opening 45 of the waste-toner accommodation unit 40 such that the belt cleaning roller 20 is exposed upwards, and contacts the lower part of the conveyance belt 18 from the lower side of the conveyance belt 18.

The relay roller 43 opposes and contacts the belt cleaning roller 20 from a rear-lower side of the belt cleaning roller 20.

In the meantime, the belt cleaning roller 20 and the relay roller 43 are applied with a cleaning bias from a power supply (not shown) provided in the body casing 2.

A rear end portion (a base end portion) of the scraping blade 44 is fixed to the waste-toner accommodation unit 40 such that a front end portion (a free end portion) thereof contacts the relay roller 43 from a lower side of the relay roller 43.

(3-4) Fixing Unit

The fixing unit 11 is arranged at the rear-upper side of the conveyance belt 18 and includes a heating roller 22, and a pressing roller 21 which is press-contacted to the heating roller 22.

(3-5) Transfer and Fixing Operations

The sheet S fed from the feeder unit 3 is conveyed from the front side towards the rear side by the conveyance belt 18 such that the sheet S sequentially passes through transfer positions at which the respective photosensitive drums 12 and the respective transfer rollers 19 are opposed to each other. During the conveyance, the toner images of respective colors carried on the respective photosensitive drums 12 are sequentially transferred onto the sheet S, so that a color image is formed.

When the sheet S passes between the heating roller 22 and the pressing roller 21, the color image transferred onto the sheet S in the transfer unit 9 is heated and pressurized, so that the color image is heat-fixed to the sheet S.

In the meantime, when the toner images of respective colors are transferred onto the sheet S, toner or paper powders may be attached on the surface of the conveyance belt 18.

The toner or paper powders attached on the surface of the conveyance belt 18 are electrically removed from the conveyance belt 18 by the belt cleaning roller 20. The toner held on the belt cleaning roller 20 is once electrically held on the relay roller 43 and then scraped off by the scraping blade 44, which is then accommodated in the waste-toner accommodation unit 30.

(4) Sheet Discharge

The sheet S having the toner images fixed thereon is discharged onto a sheet discharge tray 24, which is formed above the scanner unit 7, by respective sheet discharge rollers 23.

2. Belt Cleaning Roller and Backup Roller (1) Belt Cleaning Roller

The belt cleaning roller 20 has a substantially cylindrical shape extending in the left-right direction and is arranged to contact the conveyance belt 18 from the lower side of the conveyance belt 18 at the front-upper end portion of the waste-toner accommodation unit 40, as described above. The belt cleaning roller 20 includes a roller shaft 41, and a rubber roller 42.

The roller shaft 41 is made of metal such as stainless steel and has a substantially cylindrical shape extending in the left-right direction. A diameter of the roller shaft 41 is about 4 mm to 10 mm, for example.

The rubber roller 42 is made of a resin such as silicone and covers a surface of the roller shaft 41. A diametrical thickness of the rubber roller 42 is about 2 mm to 10 mm, for example. Also, a volume resistivity of the rubber roller 42 is about $10^5$ to $10^{10}$ Ω·cm (at 25° C.), for example.

A diameter of the belt cleaning roller 20 is about 6 mm to 20 mm, for example.

The belt cleaning roller 20 is rotated in a counterclockwise direction by a driving force from a driving source (not shown) in the body casing 2, when seen from the left side. That is, the belt cleaning roller 20 is rotated such that an upper end portion (a part contacting the conveyance belt 18) thereof is moved in an opposite direction (a direction from the front side towards the rear side) to the moving direction (a direction from the rear side towards the front side) of the conveyance belt 18.

The roller shaft 41 of the belt cleaning roller 20 is applied with a cleaning bias having an opposite polarity to the charged polarity of the toner from a power supply (not shown) in the body casing 2. For example, when the toner is positively charged, the cleaning bias having a negative polarity, specifically, the cleaning bias of −200 V to −3,500V is applied to the roller shaft 41.

(2) Backup Roller

The transfer unit 9 is provided with a backup roller 31 which is arranged to oppose the belt cleaning roller 20.

The backup roller 31 is made of metal such as stainless steel and has a substantially cylindrical shape extending in the left-right direction. A diameter of the backup roller 31 is smaller than the diameter of the belt cleaning roller 20, for example, 15% to 90% of the diameter of the belt cleaning roller 20, specifically, about 3.5 mm to 18 mm. Also, the backup roller 31 is connected to the body casing 2 to be earthed.

The backup roller 31 is arranged to oppose the belt cleaning roller 20 from the front-upper side of the belt cleaning roller 20 with the lower part of the conveyance belt 18 being interposed therebetween.

Specifically, a center axis line C1 of the backup roller 31 is arranged at a further front with respect to a line L passing a center axis line C2 of the belt cleaning roller 20 and a rearmost point (hereinafter, referred to as a contact point T) of a contact part between the belt cleaning roller 20 and the conveyance belt 18.

The contact point T is positioned outside a projection plane P which is formed by projecting the backup roller 31 in a direction connecting the center axis line C2 of the belt cleaning roller 20 and the center axis line C1 of the backup roller 31, and is arranged at the rear-upper side of the projection plane P.

3. Belt Cleaning Operation

In the above transfer operation, the conveyance belt 18 attached with the toner or paper powders on the surface thereof at the upper of the transfer unit 9 is rotated towards the lower of the transfer unit 9 by the driving of the driving roller 16 and is then moved from the rear side towards the front side.

While the conveyance belt 18 is moved from the rear side towards the front side, the conveyance belt 18 is contacted to the belt cleaning roller 20 at the contact point T.

At this time, the toner or paper powders attached on the surface of the conveyance belt 18 are transferred to the surface of the belt cleaning roller 20 by the cleaning bias applied to the belt cleaning roller 20. Then, the toner or paper powders are electrically held on the relay roller 43, scraped off by the scraping blade 44 and accommodated in the waste-toner accommodation unit 40.

In the meantime, the conveyance belt 18 from which the toner or paper powders have been removed passes between the belt cleaning roller 20 and the backup roller 31.

Specifically, after the conveyance belt 18 passes through the contact point T, the conveyance belt 18 is moved towards the front-lower side while being wrapped around the belt cleaning roller 20 and enters the projection plane P of the backup roller 31.

Then, the conveyance belt 18 passes through between the belt cleaning roller 20 and the backup roller 31 (that is, a nip portion N contacting both the belt cleaning roller 20 and the backup roller 31) and is moved towards the front side while being wrapped around the backup roller 31.

Accordingly, the cleaning operation of the conveyance belt 18 is completed.

Figure 2A:
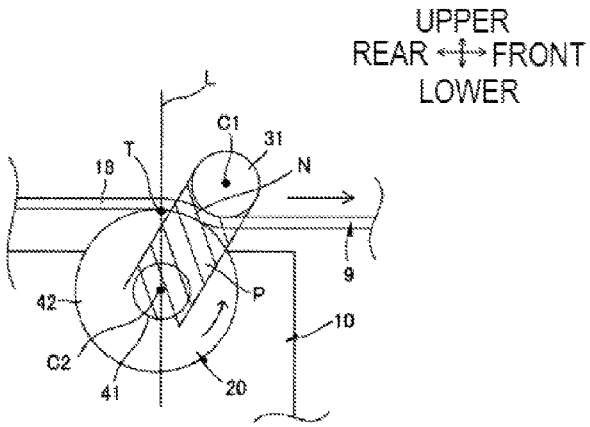

4. Operational Effects (1) According to the printer 1, as shown in FIGS. 1 and 2A, the belt cleaning roller 20 contacts the conveyance belt 18 at the rear side (the upstream side in the moving direction of the conveyance belt 18) of the nip portion N.

Thereby, it is possible to cause the conveyance belt 18 to contact the belt cleaning roller 20 before the electric discharge occurring between the belt cleaning roller 20 and the backup roller 31 strongly affects the conveyance belt 18.

Therefore, it is possible to suppress the charged polarity of the attachments such as toner or paper powders attached on the conveyance belt 18 from being changed due to the electric discharge occurring between the belt cleaning roller 20 and the backup roller 31, before the attachments contact the belt cleaning roller 20.

As a result, it is possible to securely remove the toner or paper powders attached on the conveyance belt 18.

(2) Also, according to the printer 1, as shown in FIG. 2A, the center axis line C1 of the backup roller 31 is arranged at the front side (the downstream side in the moving direction) of the line L passing the center axis line L2 of the belt cleaning roller 20 and the rearmost (most upstream side in the moving direction) point (contact point T) of the contact part between the belt cleaning roller 20 and the conveyance belt 18.

Thereby, it is possible to arrange the backup roller 31 at the front side (downstream side in the moving direction) of the contact point T and to cause the conveyance belt 18 to securely contact the belt cleaning roller 20 before the electric discharge occurring between the belt cleaning roller 20 and the backup roller 31 strongly affects the conveyance belt 18.

(3) Also, according to the printer 1, as shown in FIG. 2A, the diameter of the backup roller 31 is smaller than the diameter of the belt cleaning roller 20.

Therefore, compared to a configuration where the diameter of the backup roller 31 is larger than the diameter of the belt cleaning roller 20, it is possible to suppress the electric discharge occurring between the belt cleaning roller 20 and the backup roller 31 from strongly affecting the conveyance belt 18.

(4) Also, according to the printer 1, as shown in FIG. 1, the relay roller 43 which removes the attachments attached on the belt cleaning roller 20 is provided.

Therefore, it is possible to suppress the attachments, which are collected from the conveyance belt 18 to the belt cleaning roller 20, from returning to the conveyance belt 18. As a result, it is possible to remove the attachments attached on the conveyance belt 18 more securely.

(5) Also, according to the printer 1, as shown in FIG. 1, the scraping blade 44 which contacts the relay roller 43 and scrapes off the attachments attached on the relay roller 43 is provided.

Therefore, it is possible to suppress the attachments attached on the relay roller 43 from returning to the belt cleaning roller 20 or conveyance belt 18. As a result, it is possible to remove the attachments attached on the conveyance belt 18 more securely.

(6) Also, according to the printer 1, it is possible to remove the polymerized toner of a non-magnetic one-component type, which is difficult to be removed from the conveyance belt 18 by the physical method such as the scraping, more securely.

5. Modified Illustrative Embodiments

In the direct tandem-type color printer according to the above-described illustrative embodiment, the belt cleaning roller 20 is arranged to contact the conveyance belt 18 at the rear side of the nip portion N.

Figure 5A:
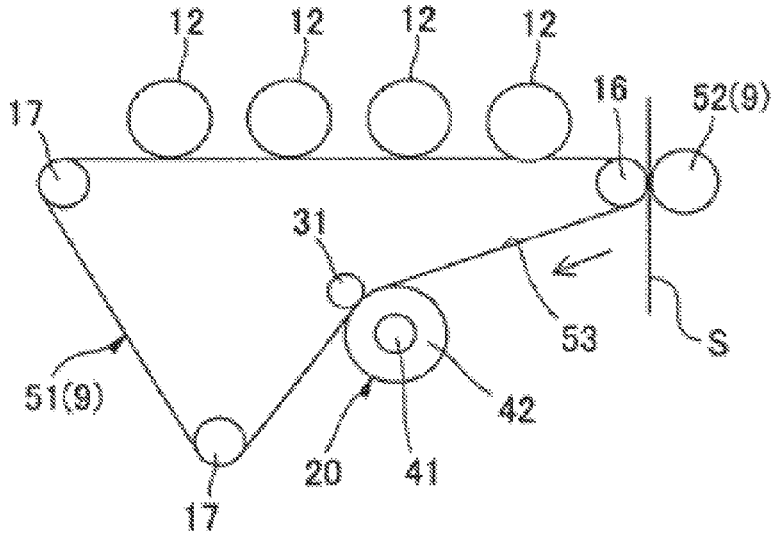
Figure 5B:
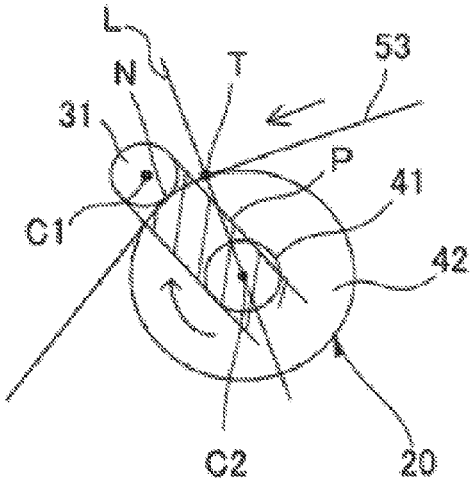

However, the relative arrangement between the belt cleaning roller 20 and the backup roller 31 can be also applied to an intermediate transfer-type color printer as shown in FIGS. 5A and 5B.

As shown in FIG. 5A, the transfer unit 9 of the intermediate transfer-type color printer includes a belt unit 51 and a secondary transfer roller 52.

The belt unit 51 includes the driving roller 16, two driven rollers 17 and an intermediate transfer belt 53 (an example of an endless belt).

The driving roller 16 and the respective driven rollers 17 are arranged such that one driven roller 17 and the driving roller 16 are arranged to oppose each other at an interval along a parallel direction (the left-right direction in FIG. 5) of the respective photosensitive drums 12 and the other driven roller 17 is arranged at the lower side of FIG. 5 to be spaced from the respective photosensitive drums 12 in a direction perpendicular to the parallel direction.

The intermediate transfer belt 53 is wound around the driving roller 16 and the respective driven rollers 17 such that the intermediate transfer belt 53 contacts the respective photosensitive drums 12 from the lower sides thereof. Also, the intermediate transfer belt 53 is rotated in the clockwise direction by the driving of the driving roller 16, when seen from the front side of FIG. 5A.

The secondary transfer roller 52 is arranged at the right side of the belt unit 51 such that the secondary transfer roller 52 is opposed to the driving roller 16 with the intermediate transfer belt 53 being interposed therebetween.

As shown in FIGS. 5A and 5B, the belt cleaning roller 20 contacts the intermediate transfer belt 53 from the right-lower side between the driving roller 16 and the driven roller 17 arranged at the lower of FIGS. 5A and 5B.

The intermediate transfer belt 53 is bent at the part contacting the belt cleaning roller 20 such that the intermediate transfer belt 53 is wrapped around the belt cleaning roller 20.

That is, the belt cleaning roller 20 contacts the intermediate transfer belt 53 at the rear side (upstream side in the moving direction of the intermediate transfer belt 53) of the nip portion N.

Also, the backup roller 31 is arranged to oppose the belt cleaning roller 20 from the left-upper side thereof with the intermediate transfer belt 53 being interposed therebetween.

Specifically, the center axis line C1 of the backup roller 31 is arranged at the left of a line L passing the center axis line L2 of the belt cleaning roller 20 and the rightmost point (hereinafter, referred to as a contact point T) of the contact part between the belt cleaning roller 20 and the intermediate transfer belt 53.

The contact point T is positioned outside a projection plane P which is formed by projecting the backup roller 31 in a direction connecting the center axis line C2 of the belt cleaning roller 20 and the center axis line C1 of the backup roller 31, and is arranged at the right-upper side of the projection plane P.

When the intermediate transfer belt 53 is moved from the driven roller 17 arranged at the upper side of FIG. 5A towards the driving roller 16, the toner images are primarily transferred from the respective photosensitive drums 12 to the intermediate transfer belt 53. Thereby, a color image is formed on the intermediate transfer belt 53.

The color image formed on the intermediate transfer belt 53 is secondarily transferred to the sheet S which is conveyed from the upper side towards the lower side of FIG. 5A, when the intermediate transfer belt 53 passes between the driving roller 16 and the secondary transfer roller 52.

At this time, the attachments such as toner which remains not transferred to the sheet S or paper powders attached to the sheet S are attached to the intermediate transfer belt 53.

While the intermediate transfer belt 53 is moved from the driving roller 16 towards the driven roller 17 arranged at the upper side of FIG. 5A, the intermediate transfer belt 53 is contacted to the belt cleaning roller 20 at the contact point T.

At this time, the toner or paper powders attached on the surface of the intermediate transfer belt 53 are transferred to the surface of the belt cleaning roller 20 by the cleaning bias applied to the belt cleaning roller 20 and are thus removed from the surface of the intermediate transfer belt 53.

In the meantime, the intermediate transfer belt 53 from which the toner or paper powders have been removed passes through the contact point T, is moved towards the left-lower side while being wrapped around the belt cleaning roller 20 and enters the projection plane P of the backup roller 31. Then, the intermediate transfer belt 53 passes between the belt cleaning roller 20 and the backup roller 31 and is moved towards the left-lower side of FIG. 5A.

Accordingly, the cleaning operation of the intermediate transfer belt 53 is completed.

EXAMPLES

In the below, the relative arrangement of the belt cleaning roller and the backup roller is further specifically described with reference to an example and comparative examples. In the example and respective comparative examples, the conveyance belt is moved from the rear side towards the front side.

1. Example and Comparative Examples

Example

As described above and as shown in FIG. 2A, the backup roller 31 is arranged at the front-upper side of the belt cleaning roller 20.

In this example, the contact point T is arranged at the rear-upper side of the projection plane P.

Comparative Example 1

Figure 3A:
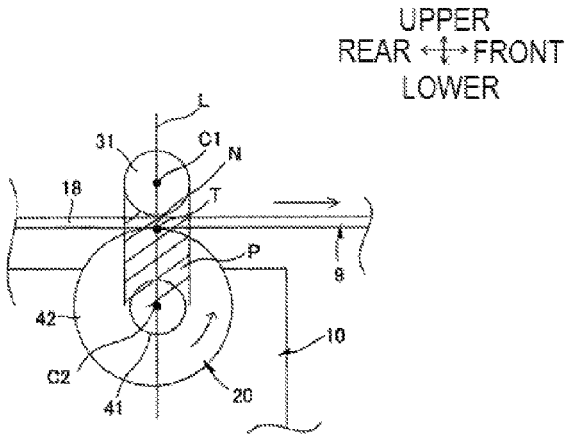

As shown in FIG. 3A, the backup roller 31 is arranged at the upper side (just above) of the belt cleaning roller 20.

In this comparative example 1, the contact point T is arranged on a line connecting the center axis line C1 of the backup roller 31 and the center axis line C2 of the belt cleaning roller 20.

Comparative Example 2

Figure 4A:
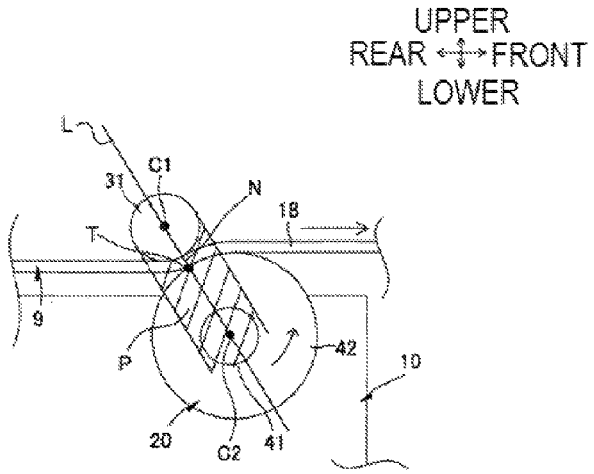

As shown in FIG. 4A, the backup roller 31 is arranged at the rear-upper side of the belt cleaning roller 20.

In this comparative example 2, the contact point T is arranged on the line connecting the center axis line C1 of the backup roller 31 and the center axis line C2 of the belt cleaning roller 20.

2. Assessment Test Method of Cleaning Performance

The performance of the bell cleaner is assessed for the relative arrangements of the belt cleaning roller and the backup roller described in the above example and respective comparative examples.

First, four assessment patches (L-edge, L-center, R-center, R-edge from the left side towards the right side) are printed along the left-right direction on the surface of the conveyance belt. Each of the assessment patches is formed with positively-chargeable polymerized toner of a non-magnetic one-component type (cyan) and has a size of 23 mm×23 mm.

Then, the assessment patches are cleaned by the belt cleaner.

At this time, the cleaning bias to be applied to the belt cleaning roller is regulated such that arbitrary current I flows between the backup roller and the belt cleaning roller. Specifically, the cleaning bias of −1000V (current I: 20 μA), −1150V (current I: 30 μA) or −1300V (current I: 40 μA) is applied to the belt cleaning roller, whereas the backup roller is earthed.

A mending tape (Scotch mending tape 810-3-24, manufactured by Sumitomo 3M Limited) is adhered onto conveyance belt after the cleaning, so that the toner remaining on the conveyance belt is transferred to the mending tape.

The mending tape having the toner transferred thereto is adhered to a pasted board (white sheet), and color (CIEL*a*b) is measured using a sphere spectrophotometer (x-rite SP64, manufactured by X-Rite Incorporated).

Separately, a mending tape having no toner attached thereto is adhered to a pasted board (white sheet) and the color is measured by the same manner.

From the color of the mending tape having the toner attached thereto and the color of the mending tape having no toner attached thereto, a color difference ΔE between the mending tape having the toner attached thereto and the mending tape having no toner attached thereto is obtained. The larger the value of the color difference ΔE, it indicates that an amount of the toner transferred to the mending tape (i.e., an amount of the toner remaining on the conveyance belt after the cleaning) is larger.

Figure 2B:
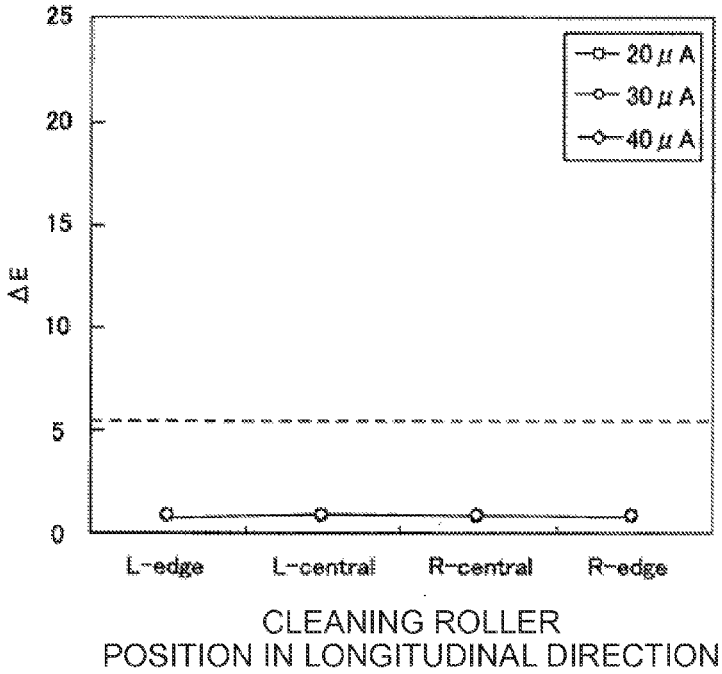
Figure 3B:
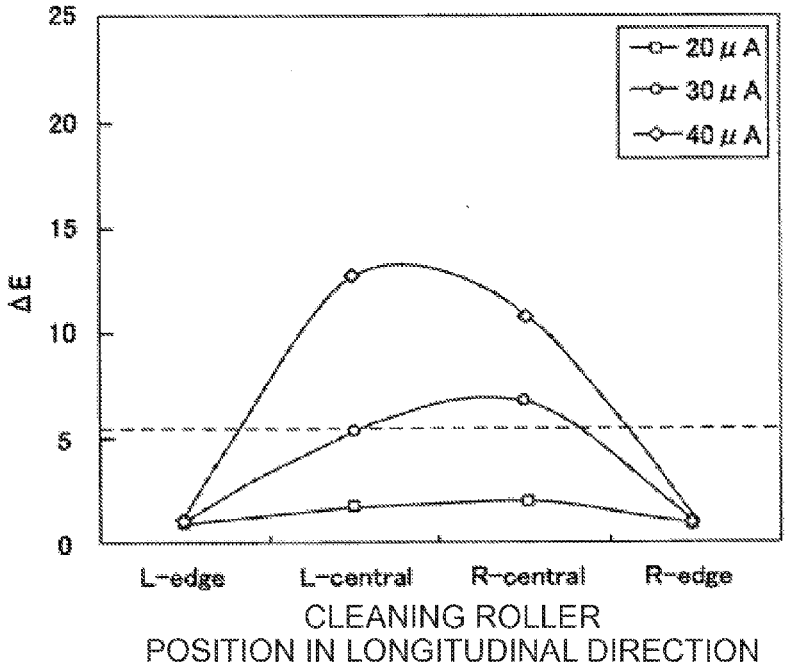
Figure 4B:
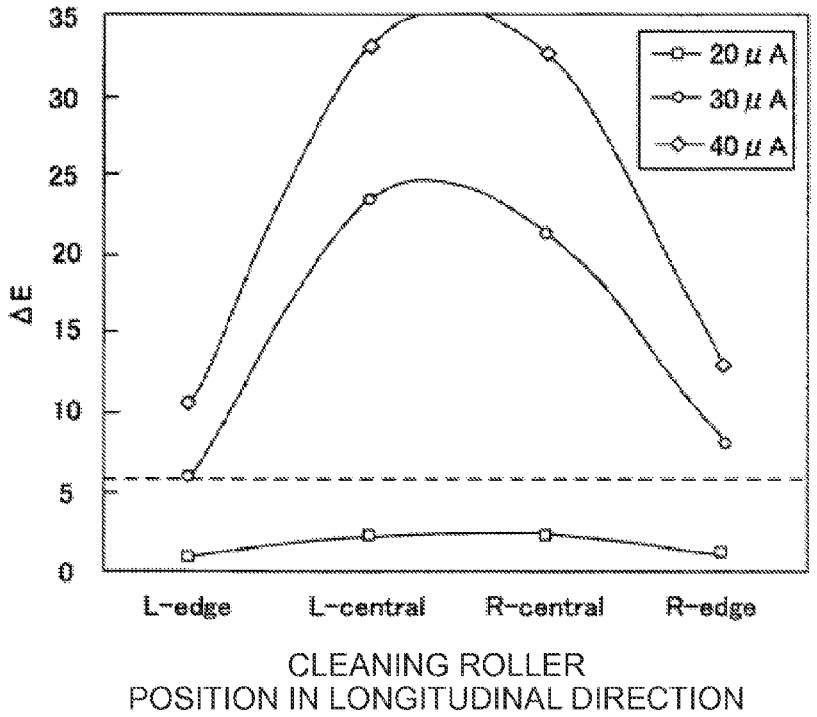

In the example and respective comparative examples, relations between the color difference ΔE and the arrangements of the respective assessment patches in the left-right direction are shown in FIGS. 2B, 3B and 4B. Specifically, FIG. 2B shows the result for the example, FIG. 3B shows the result for the comparative example 1 and FIG. 4B shows the result for the comparative example 2.

From FIGS. 2B, 3B and 4B, it can be observed that the values of the color difference ΔE of the example are substantially equal in the assessment patches at both ends in the left-right direction and are smaller in the center assessment patches in the left-right direction, compared to the values of color difference ΔE of the respective comparative examples. From this, it can be observed that the toner attached to the conveyance belt is securely removed in both left and right directions in the embodiment, compared to the respective comparative examples.

What is claimed is:

1. An image forming apparatus comprising:

a body casing;

an image carrier configured to carry thereon a developer image;

an endless belt configured to be rotated while contacting the image carrier;

a first cleaning roller including a roller shaft which is made of metal, and a rubber roller;

a power supply configured to apply a bias to the first cleaning roller; and a backup roller made of metal and arranged to oppose the first cleaning roller with the endless belt being interposed therebetween, wherein the endless belt has a nip portion at which both the backup roller and the first cleaning roller contact the endless belt while opposing each other, wherein the first cleaning roller contacts the endless belt at a more upstream side than the nip portion in a moving direction of the endless belt, and wherein the backup roller is connected to the body casing to be grounded.

2. The image forming apparatus according to claim 1, wherein a center axis line of the backup roller is arranged at a more downstream side in the moving direction than a line passing a center axis line of the first cleaning roller and a contact point of the first cleaning roller and the endless belt at a most upstream side in the moving direction.

3. The image forming apparatus according to claim 1, wherein a diameter of the backup roller is smaller than a diameter of the first cleaning roller.

4. The image forming apparatus according to claim 1, further comprising:

a second cleaning roller configured to remove attachments attached on the first cleaning roller.

5. The image forming apparatus according to claim 4, further comprising:

a blade configured to contact the second cleaning roller to scrape off attachments attached on the second cleaning roller.

6. The image forming apparatus according to claim 1, wherein the developer is polymerized toner of non-magnetic one-component type.

7. The image forming apparatus according to claim 1, wherein a contact point of the first cleaning roller and the endless belt at a most upstream side in the moving direction is positioned outside a projection plane which is formed by projecting the backup roller in a direction connecting a center axis line of the first cleaning roller and a center axis line of the backup roller.

8. The image forming apparatus according to claim 1, wherein the bias is −200V to −3,500V.

9. The image forming apparatus according to claim 1, wherein the backup roller has an electric resistance smaller than that of the first cleaning roller.

10. The image forming apparatus according to claim 9, wherein a volume resistivity of the rubber roller is about $10^5$ to $10^{10}$ Ω·cm at 25° C.

* * * * *